US012270281B2

(12) United States Patent
Gar et al.

(10) Patent No.: US 12,270,281 B2
(45) Date of Patent: Apr. 8, 2025

(54) WIPER DART HAVING A BI-DIAMETER WIPER CUP WITH PROTRUDING RING

(71) Applicant: Halliburton Energy Services, Inc., Houston, TX (US)

(72) Inventors: Shobeir Pirayeh Gar, Houston, TX (US); Lonnie Carl Helms, Houston, TX (US); Gavin Graff, Houston, TX (US); Xiaoguang Allan Zhong, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/493,468

(22) Filed: Oct. 24, 2023

(65) Prior Publication Data

US 2025/0084732 A1 Mar. 13, 2025

Related U.S. Application Data

(63) Continuation-in-part of application No. 18/466,159, filed on Sep. 13, 2023.

(51) Int. Cl.
*E21B 37/04* (2006.01)

(52) U.S. Cl.
CPC ..... *E21B 37/045* (2013.01)

(58) Field of Classification Search
CPC ..... E21B 37/10; E21B 37/02; E21B 37/00; E21B 37/045
See application file for complete search history.

(56) References Cited

U.S. PATENT DOCUMENTS

| | | | | |
|---|---|---|---|---|
| 3,085,627 | A * | 4/1963 | Sodich | E21B 33/1208 166/212 |
| 4,042,014 | A | 8/1977 | Scott | |
| 4,378,838 | A * | 4/1983 | Ogden | E21B 33/16 166/155 |
| 4,671,358 | A | 6/1987 | Lindsey, Jr. et al. | |
| 6,834,719 | B2 | 12/2004 | Fritchley et al. | |
| 7,090,024 | B2 | 8/2006 | Simpson et al. | |
| 2005/0121189 | A1 | 6/2005 | Carroll | |
| 2019/0128087 | A1 * | 5/2019 | Stair | E21B 33/16 |

FOREIGN PATENT DOCUMENTS

WO 2000023687 A1 4/2000

* cited by examiner

*Primary Examiner* — Caroline N Butcher
(74) *Attorney, Agent, or Firm* — Sheri Higgins Law, PLLC; Sheri Higgins

(57) ABSTRACT

A wiper dart can be used in an oil and gas operation. The wiper dart can have at least two different outer diameters. A first outer diameter can be less than a second outer diameter and used to wipe the insides of tool joints of a tubing string. The second outer diameter can be used to wipe the insides of pipe sections of the tubing string that have a larger inner diameter than the tool joints. The single, bi-diameter wiper cup can be used in lieu of two or more current, conical-shaped wiper cups to accomplish the same functionality. The wiper cup can include a protruding ring located circumferentially around the wiper cup at the first outer diameter. A plurality of buttons or splines can be spaced apart around the wiper cup at the second outer diameter.

20 Claims, 9 Drawing Sheets
(3 of 9 Drawing Sheet(s) Filed in Color)

WIPER DART HAVING A BI-DIAMETER WIPER CUP WITH PROTRUDING RING

TECHNICAL FIELD

A wiper dart can be used in a variety of wellbore operations. The wiper dart can have a single, bi-diameter wiper cup. The wiper cup can wipe the inside of tool joints and the inside of pipe sections of a tubing string.

BRIEF DESCRIPTION OF THE FIGURES

The patent or application file contains at least one drawing executed in color. Copies of this patent or patent application publication with color drawing(s) will be provided by the Office upon request and payment of the necessary fee. The features and advantages of certain embodiments will be more readily appreciated when considered in conjunction with the accompanying figures. The figures are not to be construed as limiting any of the embodiments.

DETAILED DESCRIPTION

Figure 2:
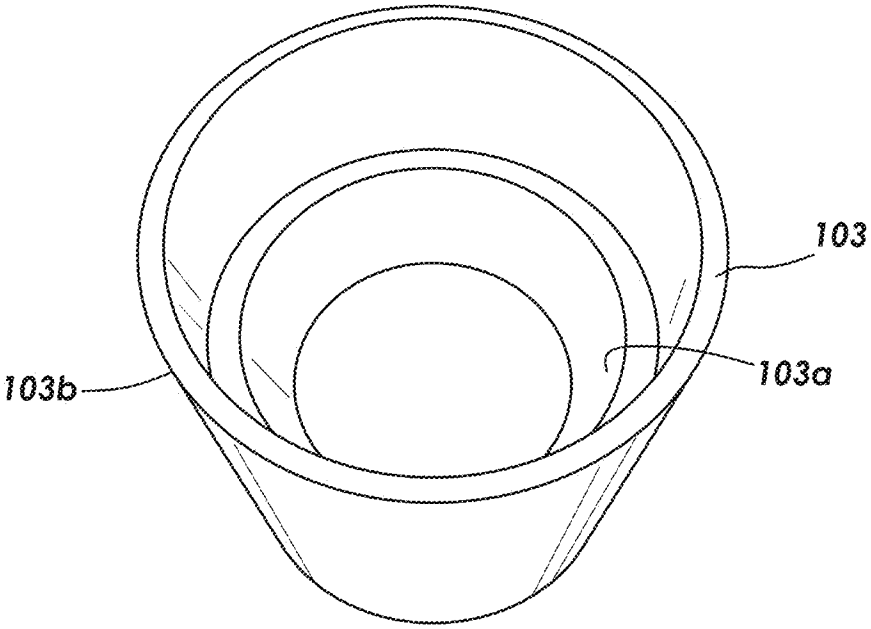
FIG. 2 is a perspective inside view of a tool joint according to certain embodiments.

Oil and gas hydrocarbons are naturally occurring in some subterranean formations. In the oil and gas industry, a subterranean formation containing oil and/or gas is referred to as a reservoir. A reservoir can be located under land or offshore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water found in or produced from a reservoir is called a reservoir fluid.

As used herein, a "fluid" is a substance having a continuous phase that can flow and conform to the outline of its container when the substance is tested at a temperature of 71° F. (22° C.) and a pressure of one atmosphere "atm" (0.1 megapascals "MPa"). A fluid can be a liquid or gas. A homogenous fluid has only one phase, whereas a heterogeneous fluid has more than one distinct phase.

A well can include, without limitation, an oil, gas, or water production well, an injection well, or a geothermal well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet radially of the wellbore. As used herein, "into a subterranean formation" means and includes into any portion of the well, including into the wellbore, into the near-wellbore region via the wellbore, or into the subterranean formation via the wellbore.

A portion of a wellbore can be an open hole or a cased hole. In an open-hole wellbore portion, a tubing string can be placed into the wellbore. The tubing string allows fluids to be introduced into or flowed from a remote portion of the wellbore. In a cased-hole wellbore portion, a casing is placed into the wellbore. A cased-hole wellbore can also contain a tubing string. A wellbore can contain an annulus. Examples of an annulus include, but are not limited to, the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

During drilling operations, a wellbore is formed using a drill bit. A drill string can be used to aid the drill bit in drilling through a subterranean formation to form the wellbore. The drill string can include a drilling pipe through which a drilling fluid or drilling mud is pumped. The wellbore defines a wellbore wall that is the exposed portion of the subterranean formation where the wellbore was formed. The drilling fluid may be circulated downwardly through the drilling pipe and back up the annulus between the wellbore wall and the outside of the drilling pipe.

Figure 1:
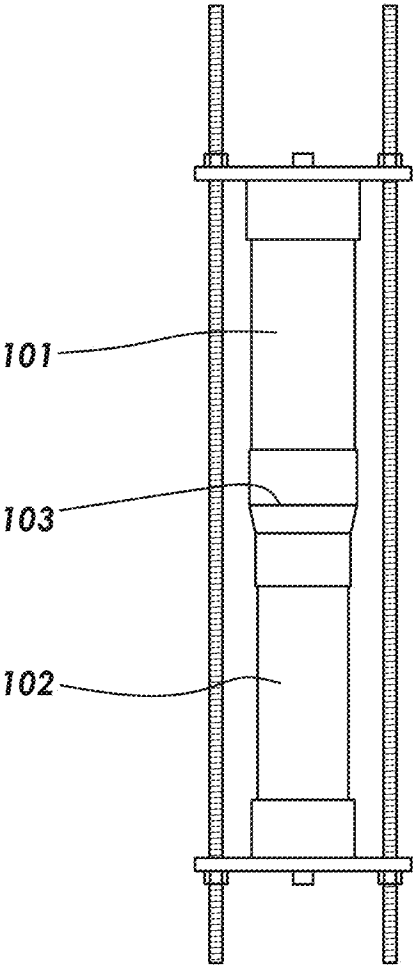
FIG. 1 is a front view of sections of a drill pipe with a tool joint according to certain embodiments.
Figure 4:
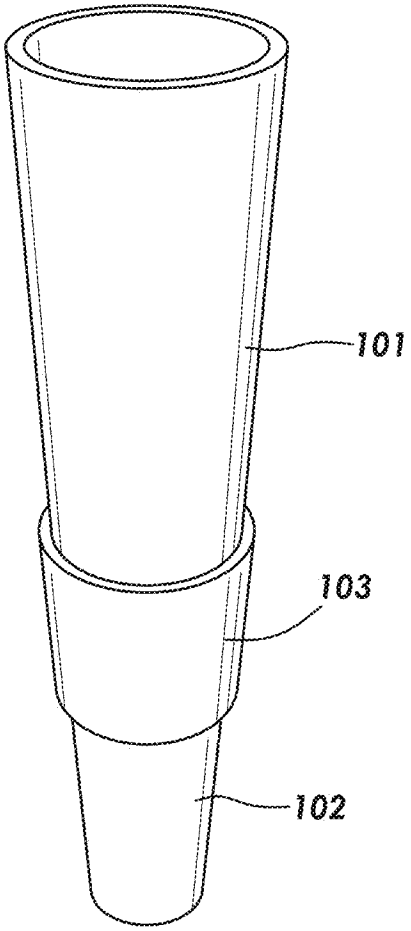
FIG. 4 is a front perspective view of both sections of drill pipe assembled with the tool joint according to certain embodiments.
Figure 3:
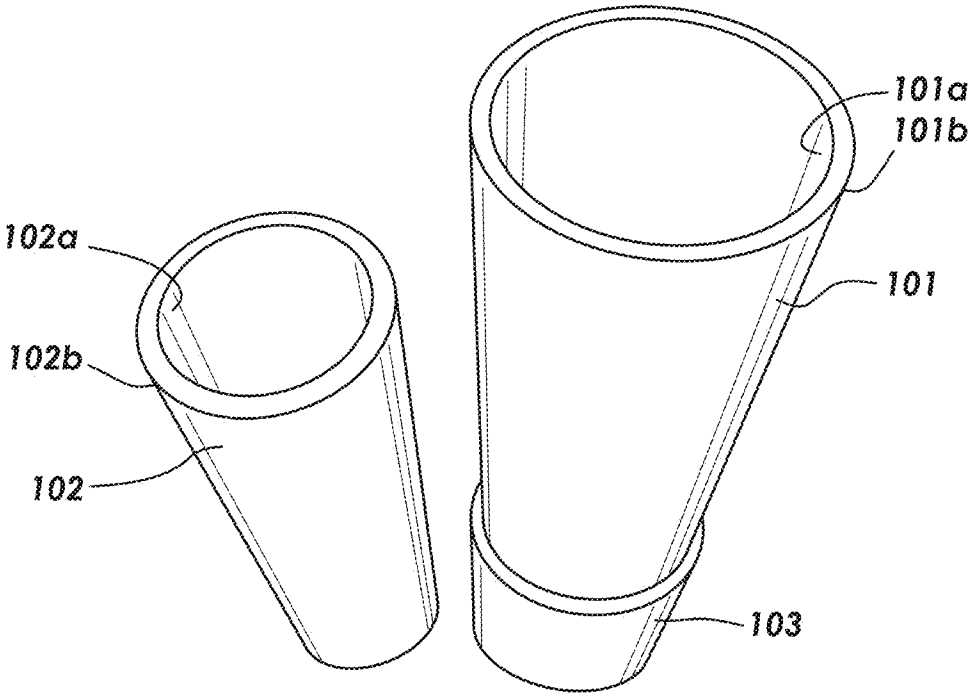
FIG. 3 is a top perspective view of a first and second section of a drill pipe having the tool joint attached to a lower end of the first section of the drill pipe according to certain embodiments.
Figure 5:
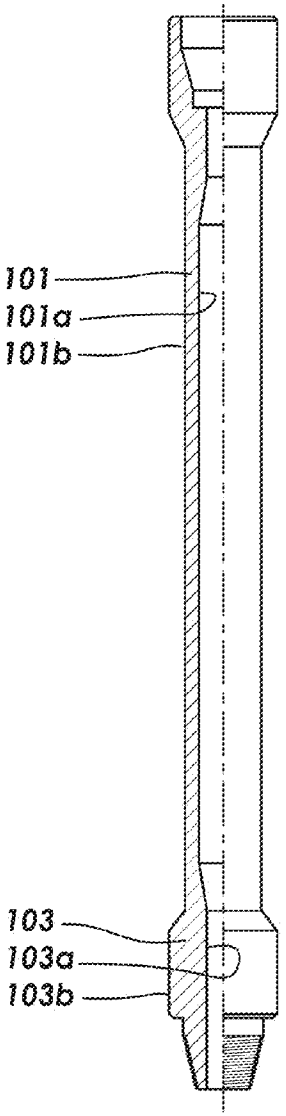
FIG. 5 is a cross-sectional view of a first section of drill pipe and tool joint showing variations in the inner diameter along the section and joint according to certain embodiments.

The drilling pipe can be formed with multiple sections of tubing that are connected together. Tool joints are also commonly used to connect the different sections of drilling pipe together. The drilling pipe can have different inner diameters. Also, not every section of drilling pipe may have the same inner diameter but can decrease in diameter. The tool joints have an inner diameter that is less than the inner diameter of the sections of drilling pipe. FIG. 1 shows an example of a first section of drilling pipe 101 connected to a second section of drilling pipe 102 via a tool joint 103. As can be seen in FIGS. 2-4, the tool joint 103 has an inner diameter 103*a* and an outer diameter 103*b*. The difference between the outer diameter 103*b* and the inner diameter 103*a* defines the thickness of the tool joint. The first section of drilling pipe 101 has an inner diameter 101*a* and an outer diameter 101*b*; and the second section of drilling pipe 102 has an inner diameter 102*a* and an outer diameter 102*b*. As with the tool joint, the difference between the outer diameter and the inner diameter is the thickness of the pipe. FIG. 5 also shows the variation of inner diameters that can be present in a single section of drill pipe and tool joints.

After a wellbore is formed, it may be desirable to perform a cementing operation. During well completion for example, it is common to introduce a cement composition into an annulus in a wellbore. In a cased-hole wellbore, a cement composition can be placed into and allowed to set in the annulus between the wellbore and the casing in order to stabilize and secure the casing in the wellbore. By cementing the casing in the wellbore, fluids are prevented from flowing into the annulus. Consequently, oil or gas can be produced in a controlled manner by directing the flow of oil or gas through the casing and into the wellhead. Cement compositions can also be used in primary or secondary cementing operations, well-plugging, or squeeze cementing. As used herein, a "cement composition" is a mixture of at least cement and water. A cement composition can include additives. As used herein, the term "cement" means an initially dry substance that develops compressive strength or sets in the presence of water.

During introduction into the wellbore, it is desirable to keep different fluids from intermixing. For example, a cement composition should not mix with a spacer fluid or the drilling fluid because the properties of the cement composition and concentrations of additives in the cement composition could be altered due to intermixing. To properly cement the well, a secure seal must be introduced and held to separate the drilling mud from the cement, which is used to propel the cement down through the casing string, out the bottom of the casing string, and up into the annulus. A wiper dart can be used to accomplish this goal. These darts are generally composed of an inner mandrel, a nose, a drive cup, and two or more conical-shaped wiper cups. The wiper cups can be located circumferentially around the outside of the inner mandrel and can function to "wipe" the inside of the string and separate fluids as the dart is being pumped into the wellbore.

Wiper darts typically include multiple wiper cups with varying outer diameters in order to effectively wipe the drilling mud from the inside of the drill pipe string having different inner diameters of pipe sections. By way of example, a wiper dart will generally include two wiper cups for the pipe sections and two more wiper cups for the tool joints for a total of four wiper cups. However, because the inner diameter (ID) of the tool joints is generally much smaller than the ID of the pipe sections, when the wiper dart passes through a tool joint, the wiper cups sized for the pipe sections tend to curl up around the edges; thus, losing the integrity of the seal and do not effectively wipe the inside of the tool joint. Even though a conical-shaped wiper cup technically has more than one outer diameter, the wiping capability is limited to the edges of the cup. Therefore, a conical-shaped wiper cup can be said to only have one outer diameter, which is the OD at the edges of the cup. Thus, traditional wiper darts must include, at a minimum, 2 wiper cups with different outer diameters at the edges—namely, one having a larger OD at the edges for the pipe sections and another one having a smaller OD at the edges for the tool joints.

Figure 6:
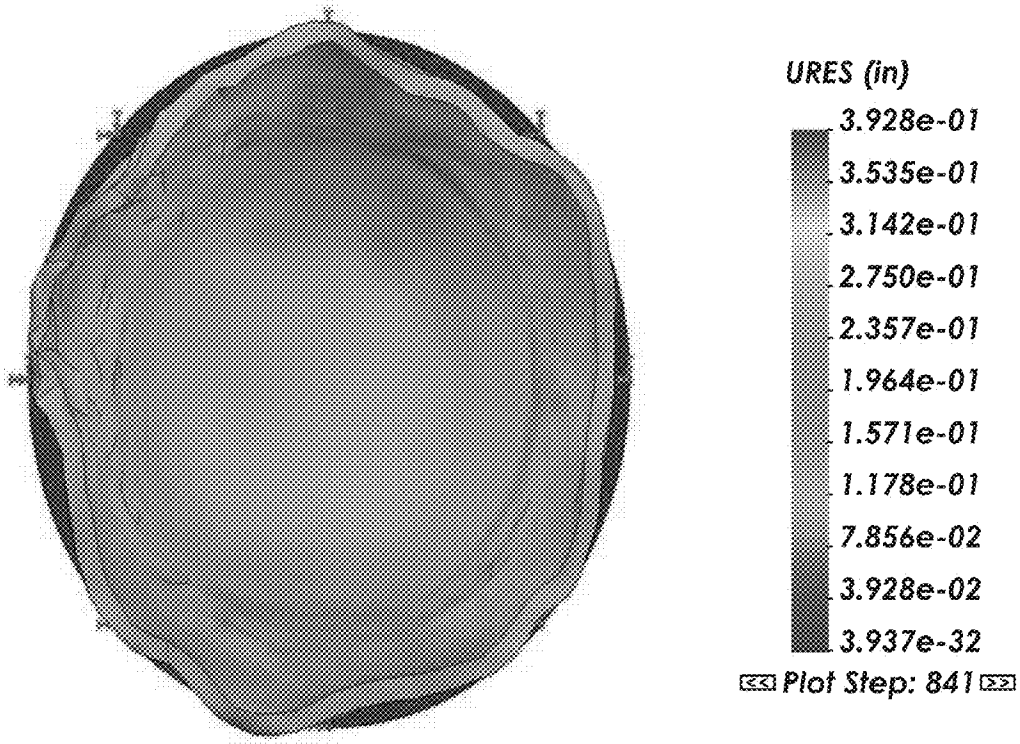
FIG. 6 shows modelling performed to show deformation or flowering of a wiper cup as it moves through a tool joint.

An example model of the effect of a conical-shaped wiper cup passing through a tool joint is shown in FIG. 6 showing how the edges of the cup have curled up or "flowered" and no longer hold a seal with the inside of the tool joint. As wiper cups slide down the pipe section and then encounter a tool joint with a smaller ID they encounter a "flowering" effect. This flowering effect describes the shape the top of the wiper cup takes as the edges bend inward forming a flower-like pattern. Thus, the pipe section cups lose their seal and cannot wipe the inside of the tool joint, so the smaller OD tool joint cups are relied on for wiping the inside of the tool joint. Once the pipe section wiper cup(s) passes completely through the tool joint into the larger ID pipe sections, then those wiper cups can uncurl. Additional wiper cups may also need to be included, especially when the pipe sections have different inner diameters from each other, or tool joints have different IDs from each other, or for providing a redundancy in the event the pipe section cup or tool joint cup is not centralized within the tubing string. By way of example, a wiper dart may typically need to include 5 different cups depending on the specifics of the wellbore.

Figure 7A:
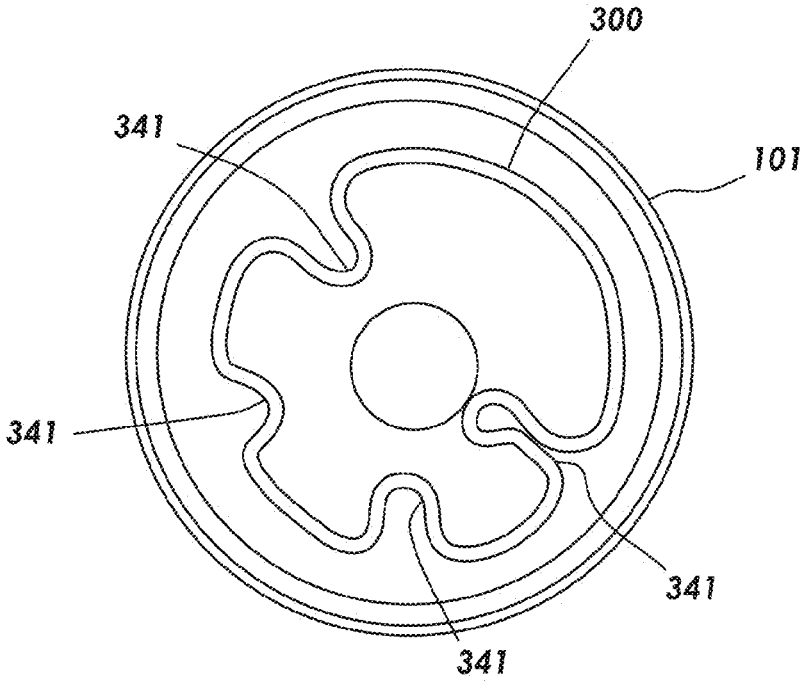
FIGS. 7A and 7B illustrate portions of the wiper cup folding in on itself and modelling performed to show how the folds create a fluid leak path as it moves through a tool joint.
Figure 7B:
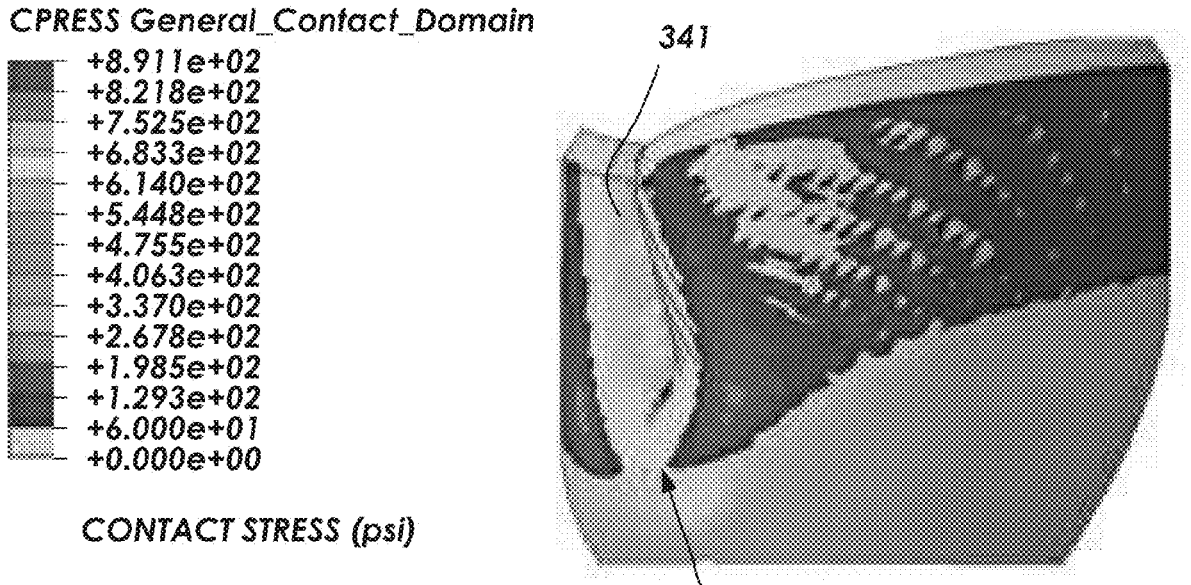

FIGS. 7A and 7B show how a typical wiper cup can have multiple areas collapse in on itself to create multiple folds 341 as the wiper cup passes through the smaller ID of tool joints. A fluid leak path 342 can occur at each of the folds 341 whereby fluid can flow past the wiper cup instead of staying behind the inside of the wiper cup. The leak paths 342 not only break the seal between the OD of the wiper cup and the ID of the drill pipe or tool joint, which can cause the pressure needed to push the wiper dart down, but also results in ineffective wiping of the inside of the drill pipe and tool joints.

There are several disadvantages to current wiper dart designs. First, having a minimum of 2 wiper cups and oftentimes 4+ wiper cups necessitate a longer inner mandrel, which increases costs and can also require specialized equipment to run such a long mandrel into the well. Second, there may need to be 10 or more different cup sizes available to accommodate a wide range of inner diameters of both pipe sections and tool joints. An operator at the wellsite must either have all the different sized cups on hand at the wellsite to assemble the wiper dart, or the operator must ensure that the correct-sized cups are delivered to the wellsite. Another disadvantage is there can be supply chain issues that prevent the correct sized cups from being on hand at the wellsite. Third, there are increased costs by needing so many different sized cups. Fourth, a vacuum can be created as the wiper cups pass through the tool joints. The vacuum created increases the pressure required to push the wiper dart through the tool joints, for example increasing the pressure required from 10-30 pounds force per square inch (psi) to 200-300 psi. Because an entire drill pipe can include several drill pipe sections and tool joints, the rubber material of the wiper cups can become abraded at every tool joint from the increased pressure, which can promote fluid leakage.

Thus, there is a long-felt need for improved wiper darts that solves the aforementioned problems. It has been discovered that a wiper dart can include a wiper cup having at least 2 different outer diameters that effectively wipe the inside of tool joints and the pipe sections.

A wiper dart can include an inner mandrel; and a wiper cup located circumferentially around the inner mandrel, wherein the wiper cup has a first outer diameter and a second outer diameter, wherein the first outer diameter is different from the second outer diameter, wherein a protruding ring is located circumferentially around the wiper cup at the first outer diameter, and wherein the first outer diameter is configured to wipe an inside of a tool joint and the second outer diameter is configured to wipe an inside of a pipe section.

A wellbore system can include a wellbore that penetrates a subterranean formation; a tubing string disposed within the wellbore, wherein the tubing string comprises one or more pipe sections and a tool joint attached to an end of the one or more pipe sections; and the wiper dart.

The various disclosed embodiments apply to the apparatus, systems, and methods without the need to repeat the various embodiments throughout. As used herein, any reference to the unit "gallons" means U.S. gallons.

Figure 8:
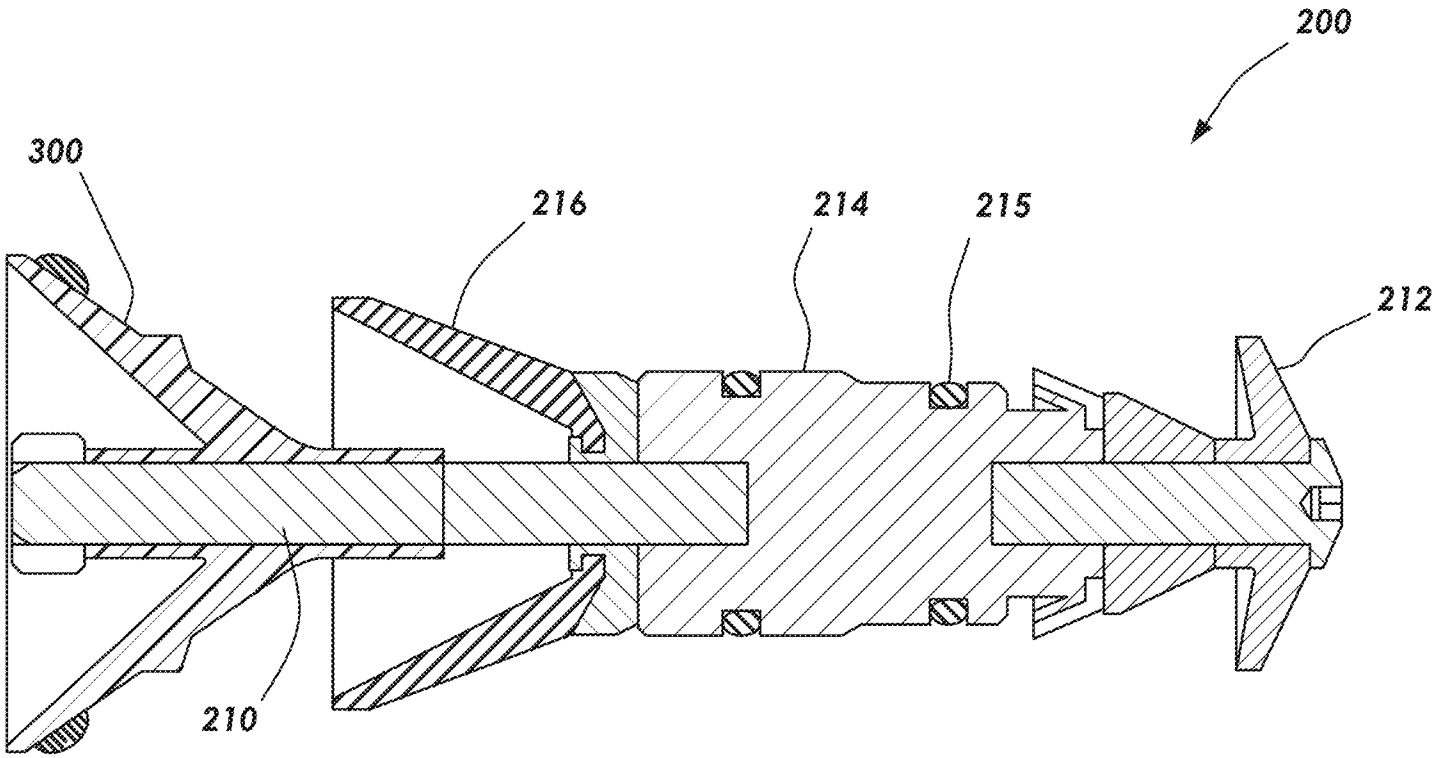
FIG. 8 is a cross-sectional view of a wiper dart with a single, bi-diameter wiper cup according to certain embodiments.

FIG. 8 is a longitudinal, cross-sectional view of a wiper dart 200 according to certain embodiments. The wiper dart 200 can include an inner mandrel 210. The inner mandrel 210 can have a variety of dimensions. The inner mandrel 110 can be made from metals, metal alloys, hard plastics, composites, or fiber reinforced resins for example.

The wiper dart 200 can include a centralizer 212 located at a first end of the inner mandrel 210. The centralizer 212 can keep the wiper dart 200 centralized within a tubing string as the wiper dart 200 is being introduced into the tubing string. The centralizer 212 can be connected to the inner mandrel 210, for example via a connector 214 and one or more lock rings 215. The tubing string can be made up of one or more pipe sections connected together with one or more tool joints, for example as shown in FIGS. 1-5. The tubing string is disposed within the wellbore that penetrates a subterranean formation. As shown, the inner diameter (ID) 103*a* of the tool joint 103 is less than the ID 101*a*/102*a* of the first and/or second pipe sections 101/102.

The wiper dart 200 can also include a drive cup 216. The drive cup 216 can be located adjacent to the connector 214. The drive cup 216 can be used to introduce the wiper dart 200 into the tubing string, for example by pumping a fluid behind the wiper dart 200 wherein the fluid pushes against the drive cup to push the wiper dart 200 through the tubing string to a desired location. The fluid can be, for example, a spacer fluid or a cement composition. The wiper dart 200 can be used to keep two different fluids separated from each other (e.g., a drilling fluid or mud and a spacer fluid or cement composition) and also wipe the inside of the pipe sections and the tool joints during introduction.

With continued reference to FIG. 8, the wiper dart 200 can include a wiper cup 300 located circumferentially around the outside of the inner mandrel 210. According to any of the embodiments, the wiper dart 200 does not include a first wiper cup having edges with a first outer diameter and a second wiper cup having edges with a second outer diameter. By way of example, the wiper dart would not include a first wiper cup having edges with an OD of 4.5 inches and a second wiper cup having edges with an OD of 2.5 inches. As used herein, the drive cup 216 is not considered to be a wiper cup. The wiper cup 300 can be slid, threaded, or molded onto the outside of the inner mandrel 210. The wiper cup 300 can be made of commonly known materials, for example, natural or synthetic rubber, urethane elastomers, or plastics that provide flexibility to the wiper cup 300. The wiper cup 300 can be connected to the inner mandrel 210, for example via a wiper cup connector (not shown). The wiper cup connector can constrain the wiper cup 300 on the outside of the inner mandrel 210 and prohibit or prevent movement along a longitudinal axis of the inner mandrel 210. Other components can be used to constrain the wiper cup 300 on the outside of the inner mandrel 210.

Figure 9:
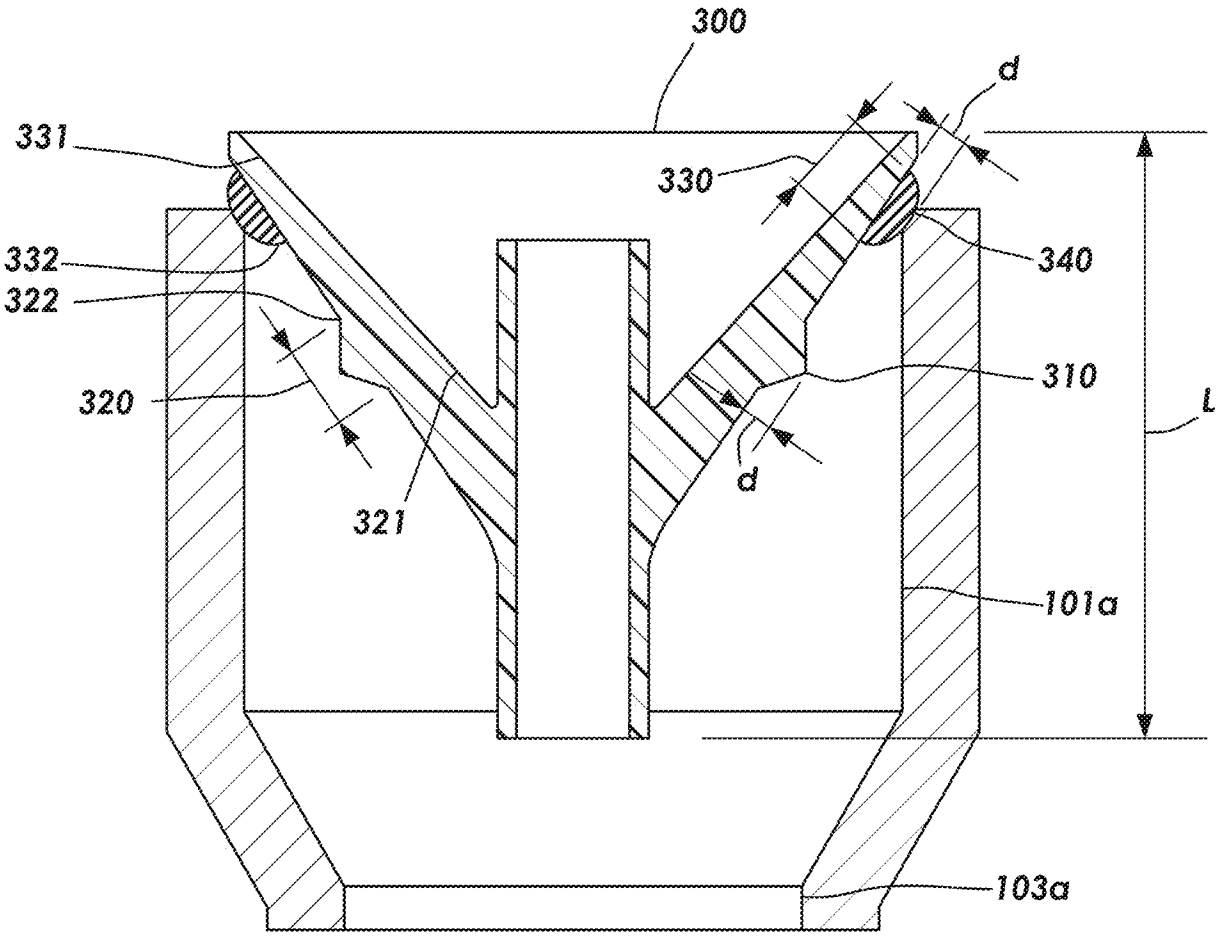
FIG. 9 is a cross-sectional view of the bi-diameter wiper cup according to certain embodiments.

Turning to FIG. 9, the wiper cup 300 has a first outer diameter (OD) 322 and a second OD 332. The wiper dart 200 can have two wiper cups 300 with the same first OD 322 and the same second OD 332 to increase stability of the wiper dart. Having two wiper cups can help the inner mandrel 210 track better and be more centralized as the wiper dart is being introduced through the tubing string and tool joints. The wiper cup 300 can include a first diameter area 320 and a second diameter area 330. The first OD 322 can be within the first diameter area 320, and the second OD 332 can be within the second diameter area 330. The first diameter area 320 can have a uniform or mostly uniform OD, and the second diameter area 330 can have a uniform OD or mostly uniform OD. The first OD 322 is different from the second OD 332. As can be seen, the first OD 322 can be less than the second OD 332. It is to be understood that unlike current wiper cup designs that are only capable of sealing and wiping at the edges of the cup for a specific size inner diameter, a single wiper cup 300 is capable of sealing and wiping not only at the edges but at both of the first diameter area 320 and a second diameter area 330. In this manner, a single wiper cup 300 can seal and effectively wipe the inside of both a pipe section and a tool joint, and therefore, the single wiper cup can replace one wiper cup for the pipe section and another wiper cup for the tool joints. Accordingly, if a typical wiper dart would require 4 total wiper cups (2 for the pipe sections and another 2 for the tool joints), then use of the novel wiper cup 300 would only require 1 cup or no more than 2 cups if improved stability was desired.

As mentioned above, current wiper darts have to utilize at least 2 wiper cups with different ODs in order to effectively seal against the inside of the tubing string and wipe the inside of the pipe sections and tool joints. Table 1 lists just a few of current wiper cup ODs at the edges of the cups and the maximum and minimum wiping ID of the pipe sections or tool joints the cup OD is capable of wiping in units of inches (in.).

TABLE 1

| Cup # | Cup OD | Maximum wiping ID | Minimum wiping ID |
|---|---|---|---|
| 1 | 5.44 | 5.26 | 4.50 |
| 2 | 4.50 | 4.32 | 3.75 |
| 3 | 5.00 | 4.82 | 4.25 |
| 4 | 4.13 | 3.95 | 3.34 |
| 5 | 3.71 | 3.63 | 3.00 |

The wiper cup 300 has the first OD 322 and the second OD 332 that are different from each other. One significant advantage to the wiper cup 300 design is that a single wiper cup 300 can be used to effectively wipe both the inside of the pipe sections of the tubing string and the inside of the tool joints instead of requiring at least 2 separate wiper cups to accomplish this goal. Accordingly, the first OD 322 and the second OD 332 can be selected to combine cup ODs of current wiper cups into a single wiper cup. By way of a non-limiting example, Table 2 shows how different current cup ODs can be combined by using the wiper cup having different first OD 322 and second OD 332.

TABLE 2

| Combined Cup #s | First OD | Second OD | Maximum wiping ID | Minimum wiping ID |
|---|---|---|---|---|
| 1 and 2 | 4.50 | 5.44 | 5.26 | 3.75 |
| 3 and 4 | 4.13 | 5.00 | 4.82 | 3.34 |
| 2 and 5 | 3.71 | 4.50 | 4.32 | 3.00 |

As can be seen in Table 2, by selecting a first OD 322 of the wiper cup 300 of 4.5 and the second OD 332 of 5.44, then the single wiper cup is able to wipe the insides of tool joints having an ID between 3.75 to 4.32 inches and also be able to wipe the insides of pipe sections having an ID between 4.5 to 5.26 inches. In this manner, the single wiper cup is able to take the place of two different wiper cups having a first cup OD of 5.44 and second cup OD of 4.5.

Multiple different first OD 322 and second OD 332 combinations can be made to replace the need for two different wiper cups as is required with current conical-shaped wiper cups. According to any of the embodiments, the first OD 322 is in a range from 3.25 to 6 inches. According to any of the embodiments, the second OD 332 is in a range from 4 to 8 inches. There can be, but does not need to be, an overlap between the maximum and minimum wiping ID of the first OD 322 and the second OD 332. By way of example, the first OD 322 can have a minimum wiping ID of 3 in. and maximum of 3.7 in., while the second OD 332 can have a minimum wiping ID of 3.6 in. and maximum of 4.5 in. According to any of the embodiments, the first OD 322 and the second OD 332 are selected based on the inner diameter of the one or more pipe sections of the tubing string, which can be the same or different, and the inner diameter of the one or more tool joints, which can also be the same or different.

As can be seen in FIG. 9, the wiper cup 300 can have a length L. The length L can be selected to provide a desired length of the first diameter area 320 and the second diameter area 330 as well as optionally a desired distance between the first and second diameter areas 320/330. The length L can be in a range of 3 to 6 inches. The first diameter area 320 can be in a range of 1 to 2 inches. The second diameter area 330 can be in a range of 1 to 2 inches. The first diameter area 320 can be angled such that the first OD 322 is in a range (e.g., from 2.5 to 3.5 inches) with a median OD of 3.0 inches. The second diameter area 330 can also be angled such that the second OD 332 is in a range (e.g., from 4.5 to 6.0 inches) with a median OD of 5.25 inches. The median OD can be selected such that the first OD 322 and second OD 332 (i.e., the median OD) has a desired maximum and minimum wiping ID. In this manner, the cup profile 310, first diameter area 320, second diameter area 330, median first OD 322, and median second OD 332 are capable of sealing against the inside of both the one or more pipe sections and the one or more tool joints to keep wellbore fluids separated and wipe the insides of the tubing string and tool joints based on the inner diameters of the pipe sections and tool joints.

As can also be seen in FIG. 9, the first diameter area 320 can include a first inner diameter 321 or a median first ID 321 in the case of an angled first diameter area 320. The difference between the first ID 321 and the first OD 322 defines a thickness of the wiper cup 300 along the length of the first diameter area 320. The second diameter area 330 can include a second ID 331 or a median second ID 331 in the case of an angled second diameter area 330. The difference between the second ID 331 and the second OD 332 defines a thickness of the wiper cup 300 along the length of the second diameter area 330. The thickness of the first diameter area 320 and the second diameter area 330 can be the same or different. The thickness of either the first or second diameter areas 320/330 can be in a range of 0.13 to 0.31 inches.

The thickness along the length of the first diameter area 320 and the second diameter area 330 can be the same or can be different at various points along the length of the diameter area. By way of example and as can be seen in FIG. 9, the thickness of the second diameter area 330 can taper from being thicker at a location closer to the first diameter area 320 and thinner at the wiper cup's edge.

Figure 10A:
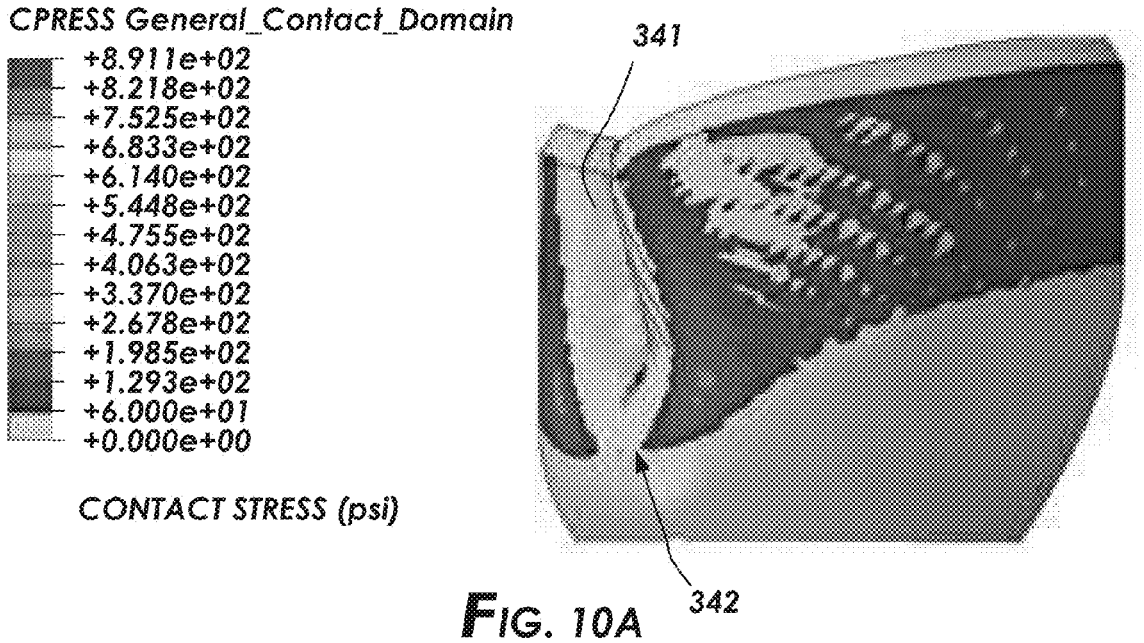
FIG. 10A illustrates modelling performed to show how folds create a fluid leak path as a wiper cup moves through a tool joint.
Figure 10B:
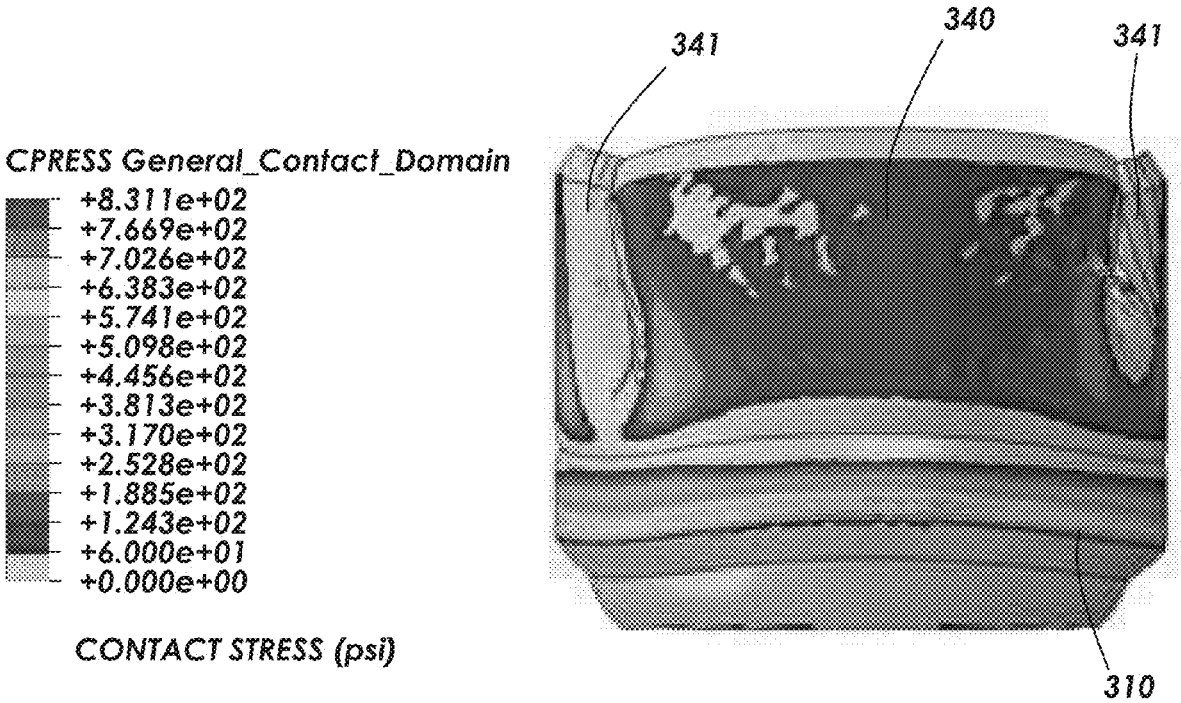
FIG. 10B illustrates modelling performed to show a protruding ring eliminates fluid leak paths adjacent to the folds.

The wiper cup 300 includes a protruding ring 310 located circumferentially around the wiper cup at the first OD 322. The protruding ring 310 is used to effectively wipe the inside of tool joints and eliminate leak paths 342. For example, and with reference to FIG. 10A, without the protruding ring 310 a current wiper cup design can have multiple folds 341 created that can allow fluid to leak past the wiper cup; whereas as can be seen in FIG. 10B, with the protruding ring 310, even though folds 341 are created, no fluid leak paths exist because the protruding ring 310 creates an effective seal within a tool joint whereby fluid cannot flow past.

Figure 11:
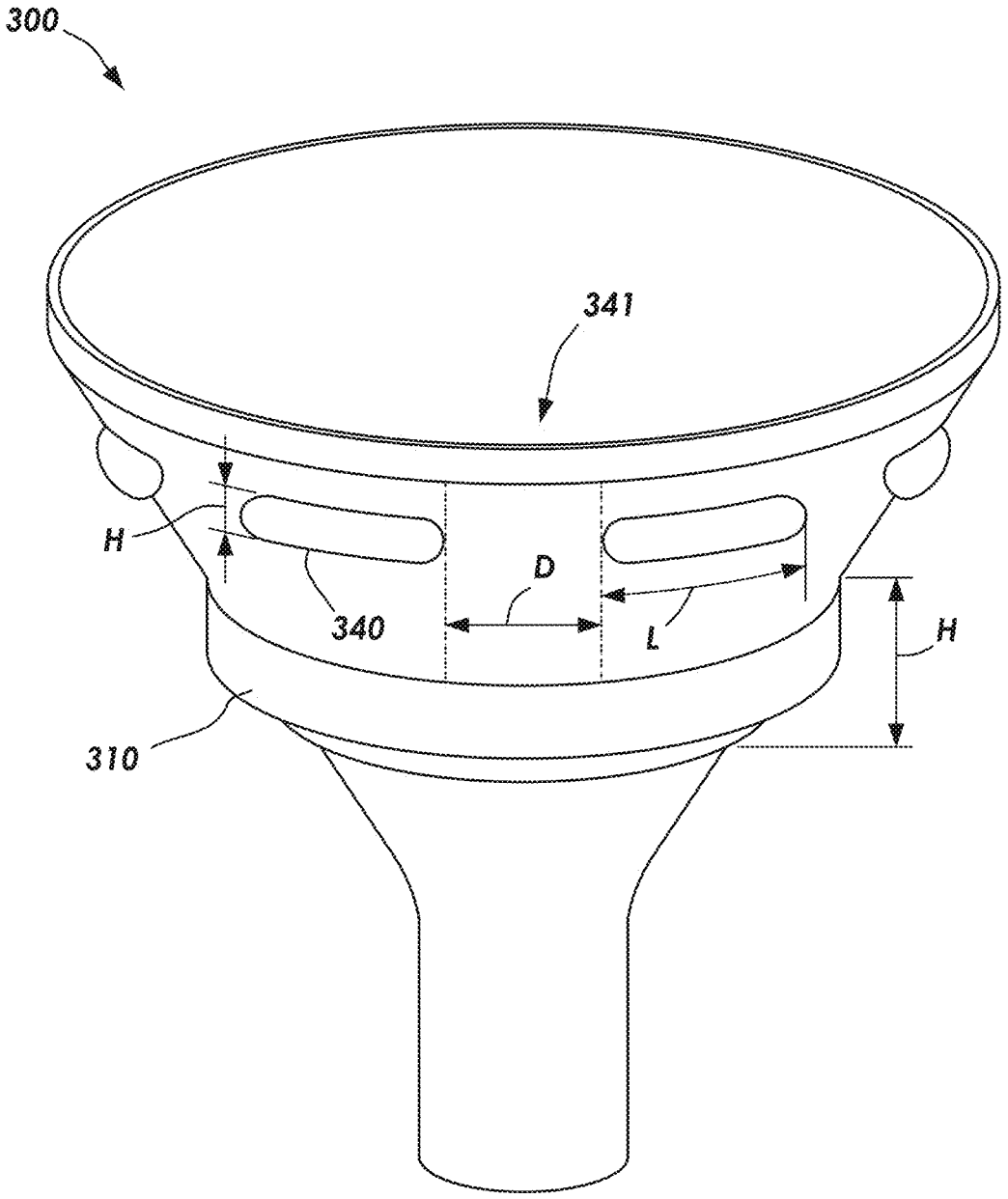
FIG. 11 is a perspective view of the bi-diameter wiper cup according to certain embodiments.
Figure 12:
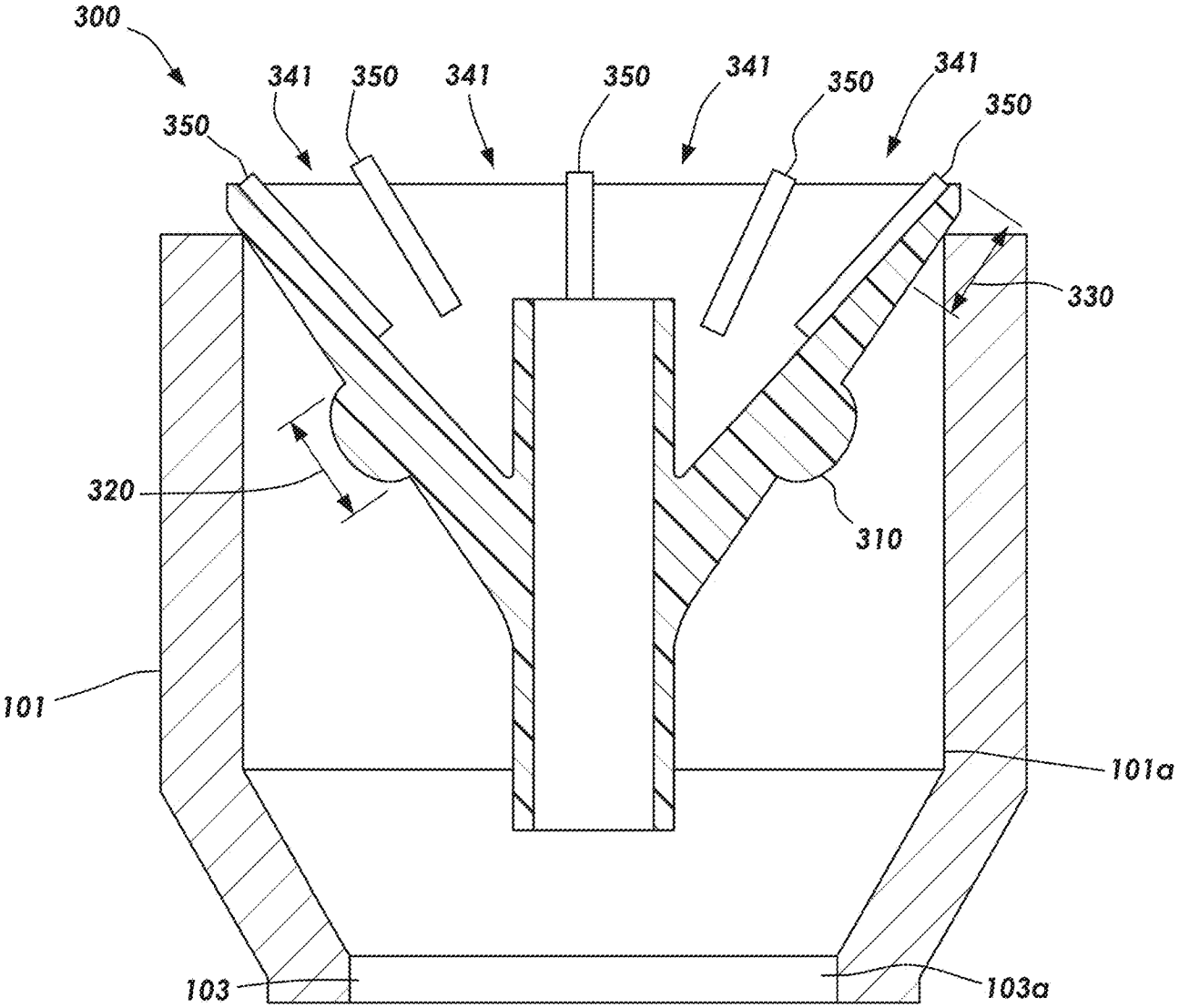
FIG. 12 is a cross-sectional view of the bi-diameter wiper cup according to certain other embodiments.

As shown in FIG. 9, the protruding ring 310 can have a triangular cross-section. The protruding ring 310 can also have different cross-sectional shapes, for example, oblong as shown in FIG. 12 or semi-circular, ovoid, rectangular, or cuboid. The protruding ring 310 spans completely circumferentially around the wiper cup 300 at the first OD 322. In this manner, there are no gaps that could create a fluid leak path, and the wiper cup 300 effectively seals and wipes the inside of tool joints. The protruding ring 310 can have a depth d extending from the outside of the wiper cup 300 at the first OD 322. The depth d can be selected such that the wiper cup 300 effectively wipes the inside of tool joints at the location of the first OD 322. The depth d can be selected based on the ID of the tool joints, the cup size, and the first OD 322. The depth d of the protruding ring 310 can be in a range of ⅛ inch to ⅜ inch (3.175 to 9.525 millimeters "mm"). As can be seen in FIG. 11, the protruding ring 310 can have a height H. The height H can be in a range of 3/16 to ⅝ inches (4.763 to 15.875 mm) and can be selected such that the protruding ring 310 effectively wipes the inside of the tool joints.

The protruding ring 310 can be made from a variety of materials, including but not limited to metals, metal alloys, hard plastics, ceramics, or rubbers. Examples of metals can include without limitation aluminum. The metal can be selected to provide for easier drilling of the wiper dart after use. Examples of metal alloys can include without limitation brass or AISI 1018, which is a high-manganese carbon steel alloy. Examples of hard plastics or ceramics can include thermoset plastics, thermoplastics such as polyether ether ketone (PEEK), hardened urethanes, ceramic buttons similar to those used in composite bridge plugs, polytetrafluoroethylene (PTFE), synthetic rubber and fluoropolymer elastomers such as VITON®, or epoxy resins molded to a desired shape. Examples of rubbers can include highly vulcanized rubbers such as NBR or HNBR. According to any of the embodiments, the material for the protruding ring 310 is a more rigid material than the material making up the remainder of the wiper cup 300. By way of example, a metal is more rigid than rubber. If the protruding ring 310 is made from a rubber, then the rubber can be more rigid than the rubber for the remainder of the wiper cup 300. By way of example, if the remainder of the wiper cup is made from a rubber having a durometer reading between 55 to 75 (e.g., NBR75), then the protruding ring can be made from a rubber having a durometer reading between 85 to 95 (e.g., NBR90). Durometer is a standardized way of measuring the hardness of materials like rubber or plastic. Hardness is a measure of how resistant a plastic is to deformation caused by mechanical indentation or abrasion. A more rigid material can also help ensure that tool joints are effectively wiped as the wiper dart is pumped through the drill pipe sections and tool joints. The protruding ring 310 can be pre-formed and then permanently attached to the outside of the wiper cup 300 at the location of the first OD 322, for example via bonding to the outside of the wiper cup, for example with an adhesive such as epoxy, silicone, or ultraviolet (UV) curable adhesives. The protruding ring 310 can also be formed during the manufacturing process of the wiper cup 300. By way of example, a mold for the wiper cup can include a channel whereby a metal, metal alloy, plastic, etc. is placed within the channel with the interface between the solid protruding ring and the wiper cup optionally roughened, then the rubber for the remainder of the wiper cup can be molded via compression, injection, or transfer molding techniques. A channel can be useful because the material for the protruding ring 310 can be completely surrounded by the material (e.g., a rubber) for the remainder of the wiper cup.

Referring to FIGS. 9 and 11, the wiper cup 300 can further include a plurality of buttons 340 spaced circumferentially around the outside of the wiper cup and located at the second outer diameter 332. The buttons 340 can allow portions of the top of the cup to collapse in on itself and create one or more folds 341, for example as shown in FIGS. 10B and 11. A fold 341 can be created between two adjacent buttons 340. The folds 341 can be created when the wiper cup 300 passes through the smaller inner diameter of the tool joints. The folds 341 can help the wiper cup 300 pass through the tool joints without having to increase the pumping pressure behind the cup to force the cup though the tool joints. As can be seen in FIG. 9, the buttons 340 can have a depth d extending from outside of the wiper cup 300 at the second OD 332. In this manner, the edges of the wiper cup can effectively wipe the inside of drill pipe sections and then when the buttons begin to encounter the decrease in inner diameters of the tool joints, the folds can be created. The buttons 340 can have a depth d, for example, in a range of ⅛ to ⅜ inch (3.175 to 9.525 mm). The buttons 340 can also be made from the same or different materials than the protruding ring 310. According to any of the embodiments, the buttons 340 are made from a more rigid material than the remainder of the wiper cup 300. The buttons 340 can also be added to the wiper cup in the same manner or different manner than the protruding ring 310. By way of example, the protruding ring 310 can be formed during an injection molding process while the buttons can be pre-formed and then attached to the outside of the wiper cup at the location of the second OD 332.

As can be seen in FIG. 11, the buttons 340 can have a height H and a length L. The number of buttons and the spacing pattern can be selected based on the desired number of folds 341 needed to be created, the desired distance D of the folds 341, and the size of the wiper cup 300. By way of example, a 4.5-inch wiper cup (11.4 centimeter "cm") can have a circumference of 14 inches (35.6 cm) and may need a total of 3 buttons that are spaced apart 4.5 inches (11.4 cm) from each other. In this manner, approximately 4 inches (10.2 cm) can collapse in to form three folds 341. The required number of buttons to induce smooth buckling and transition into the smaller ID of the tool joints can also be determined by modelling or numerical simulation.

The distance D between each of the buttons 340 for creating the folds 341 can vary and can range from 1.5 to 3 inches (3.8 to 7.6 cm) and can also be dependent on the size and circumference of the wiper cup 300. In order to provide the desired number and the desired distance D of the folds 341, the number of buttons 340 and the length L of each button 340 can vary. By way of example, for larger sized wiper cups, a total of 8 buttons may need to be included in order to provide the desired number of folds 341 and the desired distance D for each fold 341. The buttons 340 can have a length L in a range from 0.5 to 1.5 inches (12.7 to 38.1 mm) and a height H in a range of 3/16 to ⅝ inches (4.763 to 15.875 mm).

As an alternative to the buttons 340, the wiper cup 300 can include a plurality of splines 350 spaced circumferentially around the wiper cup that traverse from the edge of the wiper cup 300 and through a second diameter area 330. The splines 350 can be made from a stiffer material than the remainder of the cup and can perform the same function as the buttons to create a fold 341 between 2 adjacent splines or at each spline. The length of the splines 350 can also be selected such that the splines do not extend into the first diameter area 320. In this manner, the folds 341 can be controlled and prevented from extending into the first diameter area 320, which could undesirably create a leak path as the wiper cup moves through the smaller diameter tool joints. The splines 350 can be made from the same list of materials as for the protruding ring 310. The splines 350 can also be made from the same type of rubber as the remainder of the wiper cup 300 but can have a thickness that is greater than or less than the thickness of the cup at the second OD 332. If the rubber is thicker at each spline, then the folds will generally occur at the location between each adjacent 2 splines. If the rubber is thinner at each spline, then the folds will generally occur at the location of each spline. In this manner, the splines 350 not only create the folds 341, but also can increase the effectiveness of wiping the inside of drill pipe sections. As with the discussion above regarding the buttons 340, the number of, spacing pattern, width, length, and distance between the splines can be selected such that the desired number of folds 341 are created and the desired distance D of each fold 341 is created.

One of the many advantages of the novel wiper dart 200 having a wiper cup 300 with different outer diameters is that the total number of wiper cups needed to be selected from is greatly reduced—at a minimum the number of options available can be cut in half because a single wiper cup takes the place of at least 2 different wiper cups. This can reduce the total number of wiper cups that need to be present at a wellsite and can also obviate supply chain issues. Moreover, the total length of the inner mandrel 210 is reduced because the inner mandrel only has to be long enough to hold a single wiper cup instead of 2 or more different wiper cups. This can significantly reduce the cost of the wiper dart.

A wellbore system can include a wellbore that penetrates a subterranean formation. A tubing string can be disposed within the wellbore. The tubing string can be, for example, a drill string or a casing string. The wellbore can be formed using a drilling fluid and a drill string. The tubing string can include one or more pipe sections that are attached together, for example via a tool joint located at each end of each pipe section. Although shown in FIGS. 1 and 4 as being only 2 pipe sections and 1 tool joint, a plurality of pipe sections and tool joints can be used to make up the tubing string. The tool joint(s) can have a smaller inner diameter than the pipe sections. The tool joints can have an ID for example in a range of 3.25 to 4 inches. The pipe sections can have an ID in a range, for example in a range of 3.64 to 3.96 inches for a 4½-inch drill pipe. Drill pipe also comes in other sizes such as 5, 5½, 5⅞, 6⅝, and 8⅝ inches. Each of these different sizes can have an ID in a range similar to the range listed for the 4½-inch drill pipe. The ID of the drill pipe and the tool joints do not have to be uniform as some variance can occur within a given pipe section or tool joint. The ID of the pipe sections can be the same or different. The ID of the tool joints can be the same or different. The wellbore system can include other components.

As discussed above, the first OD 322 can be configured to wipe the inside of the tool joint, and the second OD 332 can be configured to wipe the inside of the one or more pipe sections. It is to be understood that as used herein, the term "first outer diameter" of the wiper cup means the median OD of the first diameter area 320 when the first diameter area 320 is angled. It is to be understood that as used herein, the term "second outer diameter" of the wiper cup means the median OD of the second diameter area 330 when the second diameter area 330 is angled. According to any of the embodiments, both of the first diameter area 320 and the second diameter area 330 are angled and each has a median outer diameter.

Methods of cementing in an oil and gas operation can include introducing a drilling fluid to form a wellbore. Introducing the wiper dart 200 into the wellbore. The step of introducing the wiper dart can include pumping a fluid from a wellhead of the wellbore behind the wiper dart wherein the fluid pushes against a drive cup of the wiper dart to move the wiper dart down through the tubing string. The fluid can be a spacer fluid or a cement composition. The methods can also include allowing the first OD 322 of the wiper cup 300 to wipe the inside of the tool joints and allowing the second OD 332 to wipe the inside of the one or more pipe sections.

An embodiment of the present disclosure is a wiper dart comprising: an inner mandrel; and a wiper cup located circumferentially around the outside of the inner mandrel, wherein the wiper cup has a first outer diameter and a second outer diameter, wherein the first outer diameter is different from the second outer diameter, wherein a protruding ring is located circumferentially around the wiper cup at the first outer diameter, and wherein the first outer diameter is configured to wipe an inside of a tool joint and the second outer diameter is configured to wipe an inside of a pipe section. Optionally, the wiper dart further comprises a centralizer located at a first end of the inner mandrel. Optionally, an inner diameter of the tool joint is less than an inner diameter of the pipe section. Optionally, the first outer diameter is less than the second outer diameter. Optionally, the wiper dart further comprises a drive cup. Optionally, the protruding ring has a triangular, oblong, semi-circular, ovoid, rectangular, or cuboid cross-section. Optionally, the protruding ring has a depth in a range of ⅛ inch to ⅜ inch (3.175 to 9.525 mm) and a height in a range of 3/16 to ⅝ inches (4.763 to 15.875 mm). Optionally, the protruding ring is made metals, metal alloys, hard plastics, ceramics, or rubbers having a durometer greater than a durometer of a rubber making up the wiper cup. Optionally, the wiper cup further comprises a plurality of buttons spaced circumferentially around the wiper cup at the second outer diameter. Optionally, the plurality of buttons are configured to create a fold between two adjacent buttons when the wiper cup passes through a tool joint. Optionally, a distance between each of the plurality of buttons is in a range from 1.5 to 3 inches (3.8 to 7.6 cm). Optionally, the wiper cup further comprises a plurality of splines spaced circumferentially around the wiper cup that traverse from the edge of the wiper cup and through a second diameter area. Optionally, the first outer diameter is selected such that the first outer diameter area has a maximum and minimum wiping inner diameter, and wherein the second outer diameter is selected such that the second outer diameter area has a maximum and minimum wiping inner diameter. Optionally, a first diameter area comprises a first inner diameter and the difference between the first inner diameter and the first outer diameter defines a thickness of the wiper cup along a length of the first diameter area, and wherein a second diameter area comprises a second inner diameter and the difference between the second inner diameter and the second outer diameter defines a thickness of the wiper cup along a length of the second diameter area. Optionally, the thickness of the second diameter area tapers from being thicker at a location closer to the first diameter area and thinner at edges of the wiper cup. Optionally, the first outer diameter is in a range from 3.25 to 6 inches (8.3 to 15.2 cm), and wherein the second outer diameter is in a range from 4 to 8 inches (10.2 to 20.3 cm). Optionally, the wiper cup has a length in a range of 3 to 6 inches (7.6 to 15.2 cm).

Another embodiment of the present disclosure is a system for use in a wellbore that penetrates a subterranean formation comprising: a tubing string disposed within the wellbore, wherein the tubing string comprises one or more pipe sections and a tool joint attached to an end of the one or more pipe sections; and a wiper dart, wherein the wiper dart comprises: an inner mandrel; and a wiper cup, wherein the wiper cup has a first outer diameter and a second outer diameter, wherein the first outer diameter is different from the second outer diameter, wherein a protruding ring is located circumferentially around the wiper cup at the first outer diameter, and wherein the first outer diameter is configured to wipe an inside of a tool joint and the second outer diameter is configured to wipe an inside of a pipe section. Optionally, the wiper dart further comprises a centralizer located at a first end of the inner mandrel. Optionally, an inner diameter of the tool joint is less than an inner diameter of the pipe section. Optionally, the first outer diameter is less than the second outer diameter. Optionally, the wiper dart further comprises a drive cup. Optionally, the protruding ring has a triangular, oblong, semi-circular, ovoid, rectangular, or cuboid cross-section. Optionally, the protruding ring has a depth in a range of ⅛ inch to ⅜ inch (3.175 to 9.525 mm) and a height in a range of 3/16 to ⅝ inches (4.763 to 15.875 mm). Optionally, the protruding ring is made metals, metal alloys, hard plastics, ceramics, or rubbers having a durometer greater than a durometer of a rubber making up the wiper cup. Optionally, the wiper cup further comprises a plurality of buttons spaced circumferentially around the wiper cup at the second outer diameter. Optionally, the plurality of buttons are configured to create a fold between two adjacent buttons when the wiper cup passes through a tool joint. Optionally, a distance between each of the plurality of buttons is in a range from 1.5 to 3 inches (3.8 to 7.6 cm). Optionally, the wiper cup further comprises a plurality of splines spaced circumferentially around the wiper cup that traverse from the edge of the wiper cup and through a second diameter area. Optionally, the first outer diameter is selected such that the first outer diameter area has a maximum and minimum wiping inner diameter, and wherein the second outer diameter is selected such that the second outer diameter area has a maximum and minimum wiping inner diameter. Optionally, a first diameter area comprises a first inner diameter and the difference between the first inner diameter and the first outer diameter defines a thickness of the wiper cup along a length of the first diameter area, and wherein a second diameter area comprises a second inner diameter and the difference between the second inner diameter and the second outer diameter defines a thickness of the wiper cup along a length of the second diameter area. Optionally, the thickness of the second diameter area tapers from being thicker at a location closer to the first diameter area and thinner at edges of the wiper cup. Optionally, the first outer diameter is in a range from 3.25 to 6 inches (8.3 to 15.2 cm), and wherein the second outer diameter is in a range from 4 to 8 inches (10.2 to 20.3 cm). Optionally, the wiper cup has a length in a range of 3 to 6 inches (7.6 to 15.2 cm).

Therefore, the various embodiments are well adapted to attain the ends and advantages mentioned as well as those that are inherent therein. The particular embodiments disclosed above are illustrative only, as the various embodiments may be modified and practiced in different but equivalent manners apparent to those skilled in the art and having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention.

As used herein, the words "comprise," "have," "include," and all grammatical variations thereof are each intended to have an open, non-limiting meaning that does not exclude additional elements or steps. While compositions, systems, and methods are described in terms of "comprising," "containing," or "including" various components or steps, the compositions, systems, and methods also can "consist essentially of" or "consist of" the various components and steps. It should also be understood that, as used herein, "first," "second," and "third," are assigned arbitrarily and are merely intended to differentiate between two or more pipe sections, outer diameters, etc., as the case may be, and does not indicate any sequence. Furthermore, it is to be understood that the mere use of the word "first" does not require that there be any "second," and the mere use of the word "second" does not require that there be any "third," etc.

Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent(s) or other documents that may be incorporated herein by reference, the definitions that are consistent with this specification should be adopted.

What is claimed is:

1. A wiper dart comprising:

an inner mandrel; and a wiper cup located circumferentially around the outside of the inner mandrel, wherein the wiper cup has a first outer diameter and a second outer diameter, wherein the first outer diameter is different from the second outer diameter, wherein a protruding ring is located circumferentially around the wiper cup at the first outer diameter, wherein the first outer diameter seals and wipes an inside of a tool joint and the second outer diameter seals and wipes an inside of a pipe section, and wherein patterned, circumferentially spaced folds are created adjacent to the second outer diameter when the wiper cup passes through the tool joint.

2. The wiper dart according to claim 1, further comprising a centralizer located at a first end of the inner mandrel.

3. The wiper dart according to claim 1, wherein an inner diameter of the tool joint is less than an inner diameter of the pipe section.

4. The wiper dart according to claim 1, wherein the first outer diameter is less than the second outer diameter.

5. The wiper dart according to claim 1, further comprising a drive cup.

6. The wiper dart according to claim 1, wherein the protruding ring has a triangular, oblong, semi-circular, ovoid, rectangular, or cuboid cross-section.

7. The wiper dart according to claim 1, wherein the protruding ring has a depth in a range of ⅛ inch to ⅜ inch (3.175 to 9.525 mm) and a height in a range of 3/16 to ⅝ inches (4.763 to 15.875 mm).

8. The wiper dart according to claim 1, wherein the protruding ring is made metals, metal alloys, hard plastics, ceramics, or rubbers having a durometer greater than a durometer of a rubber making up the wiper cup.

9. The wiper dart according to claim 1, wherein the wiper cup further comprises a plurality of buttons spaced circumferentially around the wiper cup at the second outer diameter.

10. The wiper dart according to claim 9, wherein the patterned, circumferentially spaced folds are created between two adjacent buttons when the wiper cup passes through the tool joint.

11. The wiper dart according to claim 10, wherein a distance between each of the plurality of buttons is in a range from 1.5 to 3 inches (3.8 to 7.6 cm).

12. The wiper dart according to claim 1, further comprising a plurality of splines spaced circumferentially around the wiper cup that traverse from the edge of the wiper cup and through a second diameter area, wherein the plurality of splines do not extend into a first diameter area, and wherein the patterned, circumferentially spaced folds are created between two adjacent splines when the wiper cup passes through the tool joint.

13. The wiper dart according to claim 1, wherein the first outer diameter is selected such that the first outer diameter area has a maximum and minimum wiping inner diameter, and wherein the second outer diameter is selected such that the second outer diameter area has a maximum and minimum wiping inner diameter.

14. The wiper dart according to claim 1, wherein a first diameter area comprises a first inner diameter and the difference between the first inner diameter and the first outer diameter defines a thickness of the wiper cup along a length of the first diameter area, and wherein a second diameter area comprises a second inner diameter and the difference between the second inner diameter and the second outer diameter defines a thickness of the wiper cup along a length of the second diameter area.

15. The wiper dart according to claim 14, wherein the thickness of the second diameter area tapers from being thicker at a location closer to the first diameter area and thinner at edges of the wiper cup.

16. The wiper dart according to claim 1, wherein the first outer diameter is in a range from 3.25 to 6 inches (8.3 to 15.2 cm), and wherein the second outer diameter is in a range from 4 to 8 inches (10.2 to 20.3 cm).

17. The wiper dart according to claim 1, wherein the wiper cup has a length in a range of 3 to 6 inches (7.6 to 15.2 cm).

18. A system for use in a wellbore that penetrates a subterranean formation comprising:

a tubing string disposed within the wellbore, wherein the tubing string comprises one or more pipe sections and a tool joint attached to an end of the one or more pipe sections; and a wiper dart, wherein the wiper dart comprises:

an inner mandrel; and a wiper cup, wherein the wiper cup has a first outer diameter and a second outer diameter, wherein the first outer diameter is different from the second outer diameter, wherein a protruding ring is located circumferentially around the wiper cup at the first outer diameter, wherein the first outer diameter seals and wipes an inside of a tool joint and the second outer diameter seals and wipes an inside of a pipe section, and wherein patterned, circumferentially spaced folds are created adjacent to the second outer diameter when the wiper cup passes through the tool joint.

19. The system according to claim 18, wherein the protruding ring has a depth in a range of ⅛ inch to ⅜ inch (3.175 to 9.525 mm) and a height in a range of 3/16 to ⅝ inches (4.763 to 15.875 mm).

20. The system according to claim 18, wherein the wiper cup further comprises a plurality of buttons spaced circumferentially around the wiper cup at the second outer diameter.

* * * * *